US006051076A

United States Patent [19]

Oechsle et al.

[11] Patent Number: 6,051,076

[45] Date of Patent: Apr. 18, 2000

[54] DEVICE FOR CLEANING A TRANSPORT BELT

[75] Inventors: Markus Oechsle, Bartholoma; Karlheinz Straub, Heidenheim, both of Germany

[73] Assignee: Voith Sulzer Papiermaschinen GmbH, Heidenheim, Germany

[21] Appl. No.: 09/049,109

[22] Filed: Mar. 27, 1998

[30] Foreign Application Priority Data

Mar. 27, 1997 [DE] Germany ..... 197 12 998

[51] Int. Cl.[7] ..... B08B 1/02; B08B 3/02; B08B 5/04; B08B 9/03; B65G 45/22

[52] U.S. Cl. ..... 134/15; 134/21; 134/24; 134/34; 134/144; 134/180; 134/181; 15/302; 198/495

[58] Field of Search ..... 134/15, 21, 24, 134/34, 144, 180, 181, 22.12, 22.11, 22.18; 15/302; 198/495

[56] References Cited

U.S. PATENT DOCUMENTS 5,783,044 7/1998 Schneider et al. ..... 162/278

5,879,515 3/1999 Straub et al. ..... 162/275

FOREIGN PATENT DOCUMENTS 19539015 10/1996 Germany .

295 21 156 U 10/1996 Germany .

*Primary Examiner*—Zeinab El-Arini

*Attorney, Agent, or Firm*—Greenblum & Bernstein P.L.C.

[57] ABSTRACT

A device for cleaning a transport belt of a machine for manufacturing a material web, in particular a paper or cardboard web, is provided which includes at least one cleaning nozzle working in conjunction with a suction chamber. Thus, the transport belt can be imparted upon with a cleaning medium; and a suction device that is connected to the suction chamber also acts on the transport belt. The device includes at least one auxiliary nozzle from which a treatment medium, preferably fluid, serving to clean the suction device can be introduced into at least one of the suction chamber and a suction line of the suction device.

17 Claims, 2 Drawing Sheets

DEVICE FOR CLEANING A TRANSPORT BELT

CROSS REFERENCE TO RELATED BACKGROUND

The present invention claims the priority under 35 U.S.C. §119 of German patent application No. 197 12 998.6 filed on Mar. 27, 1997, the disclosure of which is expressly incorporated by reference herein in its entirety.

BACKGROUND OF THE INVENTION

1. Field of the Invention

The invention relates to a device for cleaning a transport belt of a machine for manufacturing a material web, in particular a paper or cardboard web. The cleaning device includes at least one cleaning nozzle working in conjunction with a suction chamber. The cleaning nozzle can impart a cleaning medium upon the transport belt, and a suction device is connected to the suction chamber.

2. Discussion of Background Information

Devices of the type mentioned here are known. They serve to clean a transport belt disposed within a machine for manufacturing a material web, for example a porous, dry or wet, sieve belt. Such a belt is contaminated during the course of operation of the machine, for example with material fibers, adhesives, or other additives that clog the mesh or pores of the transport belt. The known device includes at least one cleaning nozzle that is associated with a suction chamber connected to a suction device. The cleaning nozzle imparts a nozzle spray upon the transport belt that removes the contaminations from the transport belt. These contaminations are removed together with the reflecting fluid or gaseous cleaning medium from the transport belt by the suction device and out through the suction chamber. It has been observed that the contaminations soil the suction line of the suction device that feeds into the suction chamber to the extent that the free cross-section of the suction line becomes smaller with continuous operation of the device. So that the operation of the device does not become impaired, the suction line must be cleaned relatively frequently, which is a great expense, since at least the suction line must be detached to do this.

SUMMARY OF THE INVENTION

It is therefore a feature of the invention to create a cleaning device that does not demonstrate this disadvantage.

Accordingly, a cleaning device is provided that introduces a cleaning medium for cleaning the suction device. The cleaning device of the present invention includes at least one auxiliary nozzle which introduces a treatment medium, preferably a fluid, into the suction chamber and/or a suction line of the suction device. The treatment medium, for example rinse water, which is introduced into the suction line from the auxiliary nozzle rinses the suction line thoroughly, such that contaminations adhering to the inner surface of the suction line, for example material fibers, adhesives, other additives, or the like, which are removed from the transport belt by the cleaning nozzle by the cleaning medium, are removed and can be rinsed out of the suction line. Thus, clogging of the free cross-section of the suction line can be inhibited.

As a result of the cleaning medium, in gaseous, steam, or liquid form, for example water, from the cleaning nozzle for cleaning the transport belt, calcium or lime, which is present in a bound form in the cleaning medium, can build up in the suction line, whereby the suction line can also become clogged. Through the treatment medium introduced by the auxiliary nozzle, it is also possible to remove or prevent the buildup these calcium deposits in the suction line. By virtue of the cleaning effect of the cleaning medium, in some cases detachment and cleaning of the suction device can be eliminated, in particular of the suction line. At the minimum, intervals the intervals between cleaning can be extended. As a result, a reduction in the operational costs of the machine for manufacturing the material web is possible. The treatment medium advantageously guarantees flawless functioning of the cleaning device, even after a longer period of operation, without having to detach and clean the cleaning device or the parts thereof. Due to its "self-cleaning" operation, the cleaning device, by means of the auxiliary nozzle, provides a high operating performance.

In accordance with a first embodiment of the cleaning device, an auxiliary nozzle is disposed on the jacket of a suction bell surrounding the suction chamber. In another embodiment, the auxiliary nozzle can spray the treatment medium directly in the suction line, for example in the end region of the suction line that feeds into the suction chamber. In a further embodiment, the treatment medium can be introduced into the suction chamber and reach the suction line through the suction effect of the suction device.

In a further embodiment of the cleaning device, the nozzle spray emanating from the auxiliary nozzle can be directed substantially parallel to the inner jacket surface of the suction bell. The nozzle spray or the flow of the treatment medium is aimed at the inner jacket surface and thus can be guided in the direction of the suction line of the suction device that feeds into the suction chamber. The treatment medium serving to clean the suction line can thereby be inhibited from reaching the transport belt. Simultaneously, the inner jacket surface of the suction bell can be cleaned and a depositing of contaminations present in the suction chamber on the suction bell can be prevented.

In an especially preferred embodiment of the cleaning device, the cleaning nozzle is disposed on a nozzle head that can rotate on an axis and that can be imparted upon by a nozzle spray from the auxiliary nozzle to produce a rotation movement On the one hand, the auxiliary nozzle provides the treatment medium that serves to clean the suction line to the suction chamber and/or the suction line, and on the other hand as an actuater for the nozzle head. The double function of the auxiliary nozzle eliminates the need for propelling nozzles, as they are known and implemented in cleaning devices for producing a rotational movement. This simplifies construction of the cleaning device.

A further embodiment of the cleaning device is preferred, in which a guide device is provided on the periphery of a nozzle head that includes at least one toothed guide element. The nozzle spray emanating from the auxiliary nozzle can be directed toward the guide device for the creation of a rotational movement. The guide element is provided in substantially the shape of a turbine vane, preferably a Pelton turbine vane. The rotational speed of the cleaning nozzle or the nozzle head can be adjusted, for example, by varying the flow volume or the velocity of the treatment medium emanating from the auxiliary nozzle.

Further embodiments and advantages can be seen from the detailed description of the present invention and the accompanying figures.

BRIEF DESCRIPTION OF THE DRAWINGS

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

DETAILED DESCRIPTION OF THE PREFERRED EMBODIMENTS

The device for cleaning a transport belt described below can generally be used in conjunction with a machine for manufacturing a material web. As an example, it is assumed in this case that the cleaning device is provided inside a paper manufacturing machine.

Figure 1:
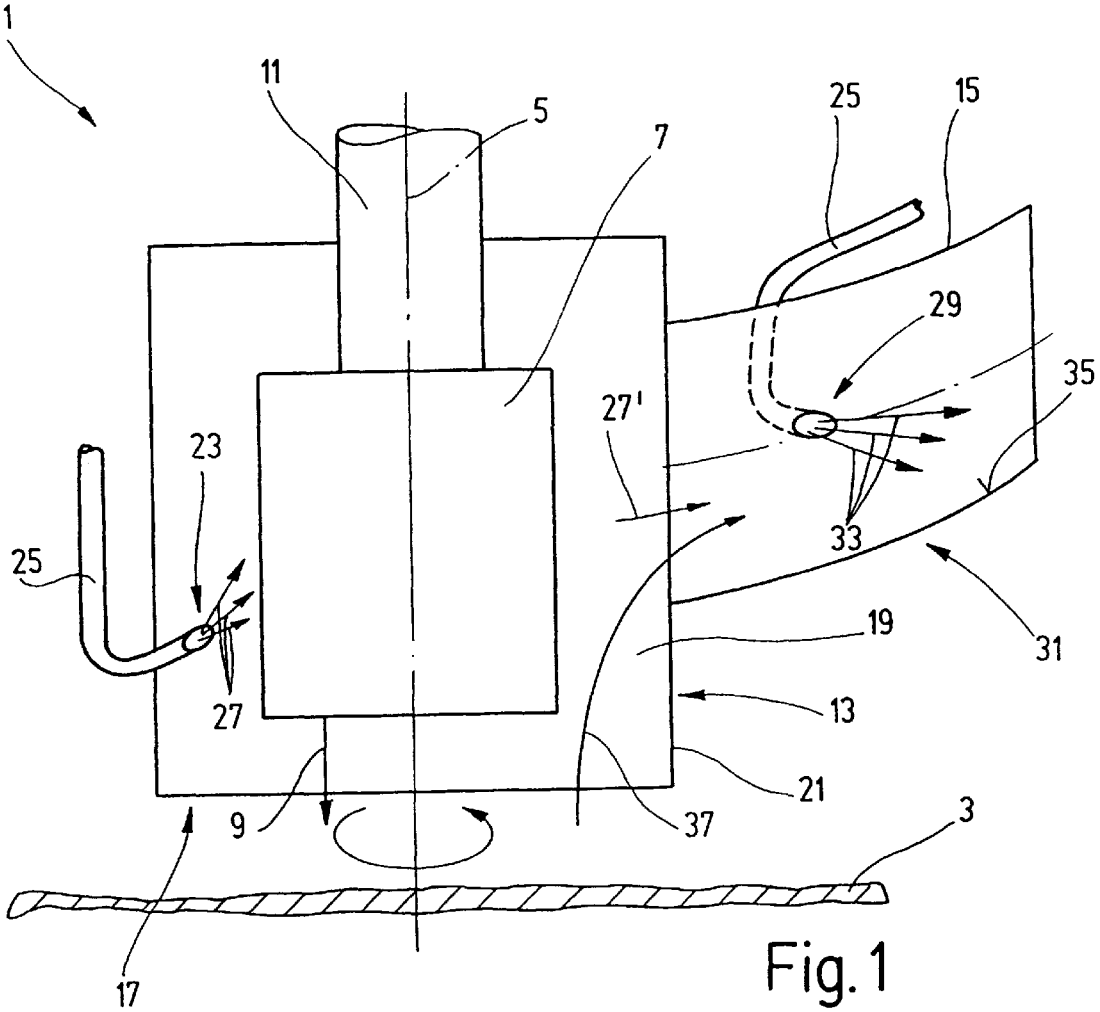
FIG. 1 depicts a schematic segment, in cross-section, of a first embodiment of the cleaning device in accordance with the invention.

FIG. 1 shows a schematic segment, in cross-section, of a first embodiment of a device subsequently referred to as cleaning device 1 for cleaning a transport belt 3. The cleaning device 1 can be employed for any transport belt of the paper manufacturing machine, for example for sieve belts or a felt of a sieve or a press or drying section of the paper manufacturing machine. The cleaning device 1 includes a nozzle head 7 that can rotate on its longitudinal axis 5. The nozzle head includes a nozzle arrangement (not depicted). The nozzle arrangement can include one or more tangentially oriented propelling nozzles to produce a rotational movement as well as one or more cleaning nozzles that impart a gaseous or fluid cleaning medium upon the transport belt 3. In the embodiment depicted in FIG. 1, only a cleaning nozzle is depicted, the nozzle spray of which is denoted by an arrow 9. As an example, it can be assumed that a cleaning agent may be a liquid, for example warm water between 20° C. and 90° C. In another embodiment, the nozzle head 7 can be locally fixed, meaning that it neither rotates on its longitudinal axis 5, nor on any other axis.

The nozzle head 7 is connected via a high-pressure line 11 to a high-pressure pump (not depicted), which provides the propelling and cleaning nozzles with a fluid that is under pressure at a preferred level of about 100 bar to about 1000 bar. The nozzle head 7 is surrounded by a cylinder-shaped suction bell 13, which is connected via a suction line 15 connecting the interior of the suction bell 13 to a suction device (not depicted). A suction chamber 19 is formed in the interior of the open-edged suction bell 13 in the end region 17 facing the transport belt 3. An auxiliary nozzle 23 is disposed on the jacket 21 of the suction bell 13 that feeds into the suction chamber 19 and is connected via a supply line 25 to a low-pressure pump (not depicted), through which the auxiliary nozzle 23 can be provided with a gaseous or fluid treatment medium that is under pressure at a preferable level of about 5 bar to about 100 bar. As an example, it can be assumed that the treatment medium may be so-called rinse water. The flow of the rinse water emanating from the auxiliary nozzle 23 is depicted by arrows 27.

A further auxiliary nozzle 29 is disposed in the end region 31 of the suction line 15 facing the suction chamber 19 that connects into the interior of the suction line 15 and, as with the auxiliary nozzle 23 disposed on the jacket 21 of the suction bell 13, has a fluid connection via a supply line 25 to the low-pressure pump. The auxiliary nozzle 29 can thus also be provided with the rinse water that is under pressure, and the nozzle spray emanating from the auxiliary nozzle 29 is depicted by arrows 33. As can be seen in FIG. 1, the nozzle spray of the auxiliary nozzle 29 impacts upon the inner surface 35 of the suction line 15 at an obtuse angle. Thus, even contaminations adhering tenaciously thereto are removed and rinsed away with the treatment medium. Furthermore, it is possible for the nozzle spray from the auxiliary nozzle 29 to impact upon the inner surface 35 at an acute angle, so that the contaminations are seemingly peeled off of the inner surface 35.

During the operation of the cleaning device 1, the propelling nozzles disposed on the nozzle head 7 and the cleaning nozzle are provided with fluid under pressure via the high-pressure line 11, which causes the nozzle head 7 to rotate about its longitudinal axis 5, and the transport belt 3, which is guided past the cleaning device 1, to be imparted upon by the fluid emanating at a high velocity from the cleaning nozzle. The material fibers, particles, adhesives, and other additives or the like, subsequently referred to as contaminations, are thereby removed from the transport belt 3. During the cleaning process, a contamination and/or fluid mist forms, which, together with the remaining fluid, as designated in FIG. 1 by an arrow 37, is suctioned by the suction device into the suction chamber 19. The contamination mixes with the rinse water that is supplied to the suction chamber 19 via an auxiliary nozzle 23 (see arrow 27) and is lead away by the suction line 15. In addition, further rinse water is supplied via the auxiliary nozzle 29 disposed in the suction line 15. The rinse water inhibits depositing of contaminations on the inner surface 35 of the suction line 15 or removes adherent contaminations. Thus, clogging of the suction line 15 is thereby inhibited in an advantageous manner, such that the desired operation of the cleaning device 1 can be maintained even after extended operation, and breakdowns can be avoided. It is clear that the auxiliary nozzles 23, 29 do not contribute to the cleaning of the transport belt 3, but serve to introduce additional fluid into the suction line 15, which rinses away contaminations from the suction line 15 that have been removed from the transport belt 3.

In a first variation of the cleaning device 1, the auxiliary nozzles 23, 29 continually bring in a treatment medium, during operation of the cleaning device 1, into the suction chamber 19 or into the suction line 15. Alternatively, it is also possible to let the treatment medium emanate from the auxiliary nozzles 23, 29 only in intervals. Through this measure, the consumption of the treatment medium can be reduced, for example, with transport belts that are just slightly contaminated It is also possible that the cleaning device 1 includes a single auxiliary nozzle that is disposed in the suction line or on the jacket of the suction bell. Of course, more than two auxiliary nozzles also can be provided, which bring rinse water into the region suctioned by the suction device.

Figure 2:
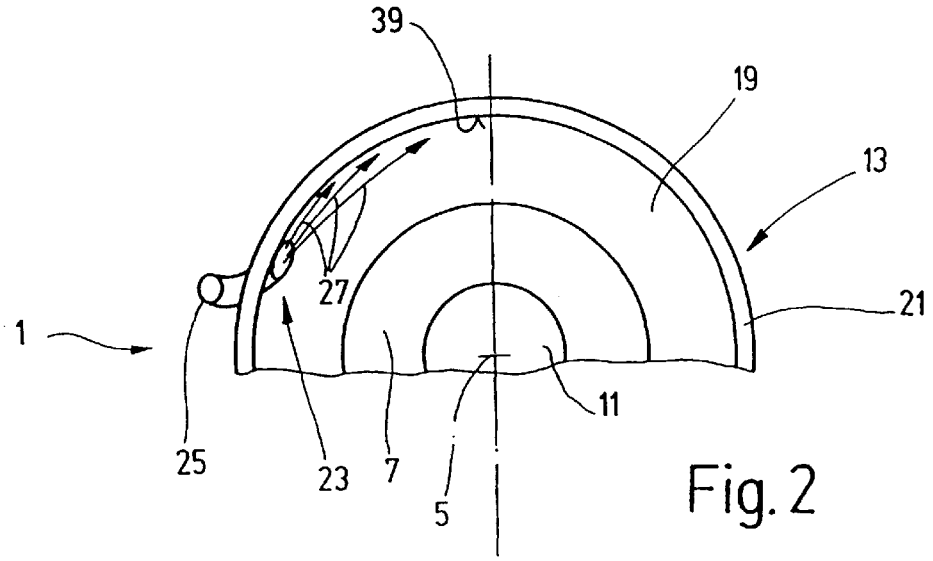
FIG. 2 depicts a schematic top-view of a portion of the cleaning device in accordance with the embodiment of FIG. 1.

FIG. 2 shows a schematic top-view of a portion of the cleaning device 1 depicted in FIG. 1. The same parts are designated with the same reference numerals, so that one can refer to the description for FIG. 1. The nozzle spray emanating from the auxiliary nozzle 23 into the inner chamber 19 runs, as is depicted by arrows 27, tangentially to the inner jacket surface 39 of the suction bell 13. The result of which is that the flow of the treatment medium is applied to the inner jacket surface 39 of the suction bell 13 and is therewith guided along substantially parallel to the inner jacket surface 39, that is, around the nozzle head 7, in the direction toward the suction line 15, which is not depicted in FIG. 2.

Figure 3:
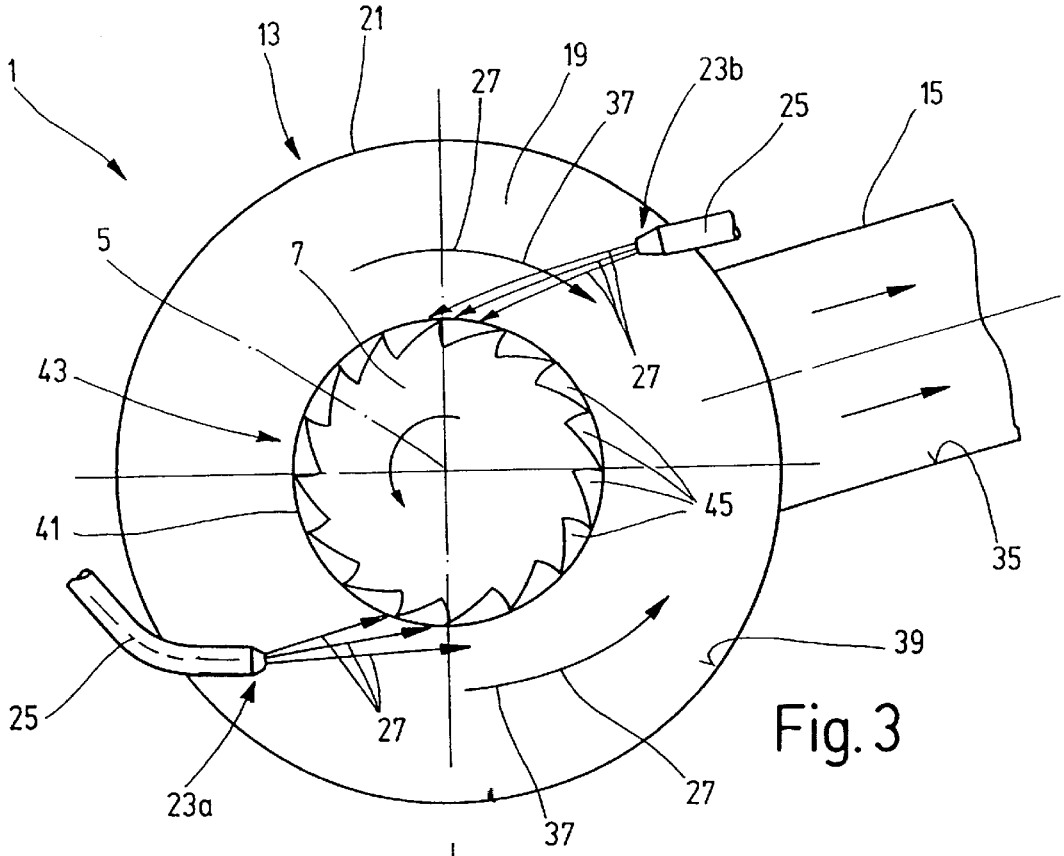
FIG. 3 depicts a schematic top-view of a further embodiment of the cleaning device.

FIG. 3 shows a schematic top-view of a further embodiment of the cleaning device 1. Parts that correspond with those in the previous FIGS. 1 and 2 are designated with the same reference numerals, so that one can refer to the description of FIGS. 1 and 2 for an understanding of the corresponding parts. In the following, only the differences are discussed. The cleaning device 1 includes a nozzle head 7 that can rotate on the axis 5, and on the periphery 41 of the nozzle head a guide device 43 is provided that includes at least one, and in this case numerous, guide elements 45 distributively arranged over the peripheral surface 41 of the nozzle head 7. The guide elements have a toothed contour. In the context of the present invention, "toothed" means having the shape of any turbine vane.

Figure 4:
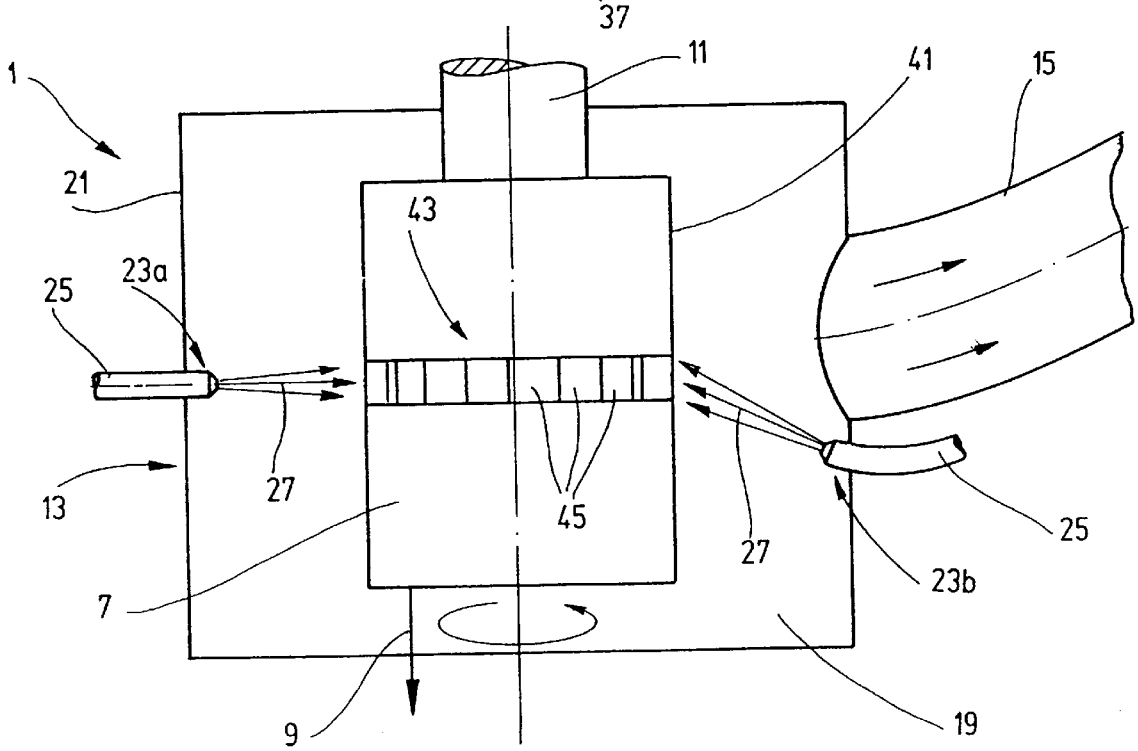
FIG. 4 depicts a schematic segment, in cross-section, of the cleaning device in accordance with FIG. 3.

As can be seen in FIG. 4, which shows a schematic cross-section of the cleaning device 1 depicted in FIG. 3, the guide device 43 is integrated in the peripheral surface 41 of the nozzle head 7, i.e. the guide elements 45 do not project outwardly of the outer surface of the peripheral surface 41 of the nozzle head 7. In another embodiment, the guide device 43 may be mounted externally on the peripheral surface 41 of the nozzle head 7. The cleaning device 1 includes auxiliary nozzles 23*a* and 23*b*, which, as can be seen in FIG. 3, are mounted on opposing sides of the suction bell 13 and on the jacket 21 and can be provided, via supply lines 25, with rinse water that is under pressure. The nozzle spray emanating from the auxiliary nozzles 23*a*, 23*b* is depicted by arrows 27.

The nozzle sprays emanating from the auxiliary nozzles 23*a*, 23*b* are directed at the guide device 43 that is integrated in the peripheral surface 41 of the nozzle head 7, whereby the nozzle spray emanating from the auxiliary nozzle 23*a* impacts the guide device 43 substantially radially and the nozzle spray from the auxiliary nozzle 23*b* impacts the guide device 43 diagonally from below. Therefore, the nozzle head 7 rotates about its longitudinal axis 5 in a counter-clockwise motion, as is depicted by an arrow (not numbered). The treatment medium, i.e. rinse water, that is introduced into the suction chamber 19 from the auxiliary nozzles 23*a*, 23*b*, as depicted with arrows 27, 37, is carried away via the suction line 15 together with the dirt and/or fluid mist and remaining fluid that was removed from the transport belt 3 by the nozzle sprays. Thus, the suction line 15 is thoroughly rinsed by the treatment medium, such that a clogging of the suction line 15 can be inhibited. Through the double function of the auxiliary nozzles 23*a*, 23*b*, namely the introduction of treatment medium in the suction line 15 and the actuation of the nozzle head 7, the construction of the cleaning device 1 can be simplified and its operating costs reduced.

The auxiliary nozzles 23, 29, 23*a*, and 23*b* described with the aid of FIGS. 1 through 4 preferably have a diameter of about 1 mm to about 5 mm. The diameter of the cleaning nozzle that can be provided with a fluid that is under high pressure, as well as the diameter of the propelling nozzles for producing a rotational movement of the nozzle head 7 as described in FIG. 1, is preferably less than about 1 mm. Through the small diameter of the propelling and cleaning nozzles, the amount of fluid required for the cleaning of the transport belt can be reduced while retaining the same degree of cleaning effectiveness.

Due to the small diameter of the cleaning and propelling nozzles, the cleaning medium must be processed before it is guided to the nozzles via the high-pressure pump, so that the cleaning and propelling nozzles do not clog and become inoperative during the operation of the cleaning device 1. The expression "processing" the cleaning medium means, for example, use of special bonding means and/or a filtering of the fluid. To process the fluid, a water processing apparatus can be arranged prior to the high-pressure pump, which treats the water by, preferably, providing a temperature about 20° C. to about 90° C., and filtering such that the size of the particles in the water is at most about 100 $\mu$m, preferably less than or equal to about 50 $\mu$m, and the water has a maximum 100 dH (dH German hardness).

In the following, the construction of an embodiment of the water processing apparatus is discussed in more detail. The water processing apparatus includes a water supply line, a motor-driven proportioning pump, a mixing container or a mixing section and a filter, for example, a backwash filter. The water volume flowing through the water supply line is measured by a flowmeter, which controls the proportioning pump. Additives, such as biocide, complexing agents and/or a hardness stabilizer, which are subjected to the volume flow, are added via the proportioning pump to the water in the water feed line in order to attain a desired water quality. Thereafter, the water reaches a mixing container, in which the additives are mixed with the water. Immediately thereafter, the water flows through the filter, in which the particles up to a certain size are filtered out of the water. The processed water is then led via the high-pressure pump to the cleaning nozzle and the propelling nozzles.

Because the auxiliary nozzles have a relatively large diameter, a profuse and expensive processing of the treatment medium, i.e. the rinse water, can be eliminated, since, due to the relatively large diameter of the auxiliary nozzles, the danger of the auxiliary nozzles becoming clogged can be practically eliminated. The treatment medium can also have a poorer quality than the cleaning medium and is therefore less expensive. Furthermore, the operating costs of the cleaning device 1 can be further reduced with an actuation of the nozzle head 7 as described with the aid of FIGS. 3 and 4, since the costs for the providing of a treatment medium that is under relatively low pressure are less than those of providing a treatment medium that is under relatively high pressure. The relatively high pressure medium is, therefore, used exclusively to clean the transport belt 3 and not, as is conventional in known cleaning devices, supply propelling nozzles to create a rotational movement.

In conclusion, it must be remembered that through the introduction of the treatment medium into the suction chamber or directly into the suction line of the suction device, a clogging or stopping-up of the regions of the cleaning device, through which the contaminations removed from the transport belt are removed, can be practically eliminated. In light of that fact, the consistency of performance of the cleaning device 1 can be increased in an advantageous manner.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

We claim:

1. A device for cleaning a transport belt of a machine for manufacturing a material web, comprising:

at least one cleaning nozzle for cleaning the sport belt, working in conjunction with a suction chamber, whereby the transport belt can be sprayed with a cleaning media;

a suction device connected to the suction chamber; and at least one auxiliary nozzle for introducing a cleaning medium into one of the suction chamber and a suction line of the suction device for cleaning the suction device.

2. A device in accordance with claim 1, wherein said cleaning medium is a fluid.

3. A device in accordance with claim 1, wherein said auxiliary nozzle is disposed on a jacket of a suction bell that surrounds the suction chamber.

4. A device in accordance with claim 3, wherein a nozzle spray emanates from said auxiliary nozzle and is directed substantially parallel to an inner jacket surface of the suction bell.

5. A device in accordance with claim 1, wherein said auxiliary nozzle is arranged in an end region of the suction line that faces the suction chamber.

6. A device in accordance with claim 5, wherein a nozzle spray emanates from said auxiliary nozzle and impacts an inner surface of the suction line at an obtuse angle.

7. A device in accordance with claim 1, wherein said auxiliary nozzle has a diameter of about 1 mm to about 5 mm.

8. A device in accordance with claim 1, wherein a low-pressure pump assigned to said auxiliary nozzle provides the auxiliary nozzle with a treatment medium that is under pressure at a rate of about 5 bar to about 100 bar.

9. A device in accordance with claim 1, wherein said cleaning nozzle is disposed on a nozzle head that is rotatable about a longitudinal axis, and which can receive a nozzle spray of the auxiliary nozzle to create a rotational movement of the nozzle head.

10. A device in accordance with claim 1, wherein a guide device is provided on a periphery of a head of said nozzle and said guide device includes at least one toothed guide element.

11. A device in accordance with claim 10, wherein said guide device is provided by one of forming said guide device integrally with said nozzle head and disposing said guide device on said nozzle head.

12. The device for cleaning a transport belt according to claim 1, wherein the material web comprises a paper or cardboard web.

13. A method for cleaning a tansport belt of a machine for manufacturing a material web, comprising:

spraying a cleaning medium under pressure from a cleaning nozzle onto the transport belt to clean the transport belt;

suctioning the cleaning medium and contaminants from the transport belt by a suction chamber connected to a suction line;

providing an auxiliary nozzle on at least one of said cleaning nozzle, said suction chamber and said suction line to at least one of clean a respective one of said suction chamber and said suction lie and rotate said cleaning nozzle; and spraying an additional cleaning medium from said auxiliary nozzle into said at least one of said suction chamber and said suction line to clean a respective one of said suction chamber and said suction line.

14. A method for cleaning a transport belt in accordance with claim 13, wherein said additional cleaning medium is sprayed into said suction chamber.

15. A method for cleaning a transport belt in accordance with claim 13, wherein said additional cleaning medium is sprayed into said suction line.

16. A method for cleaning a transport belt in accordance with claim 13, wherein said cleaning nozzle is rotatable, and said additional cleaning medium is sprayed onto said cleaning nozzle to effect rotation thereof.

17. The method for cleaning a transport belt according to claim 13, wherein the material web comprises a paper or cardboard web.

* * * * *